US005587204A

United States Patent [19]

Kinsey, Jr. et al.

[11] Patent Number: 5,587,204

[45] Date of Patent: Dec. 24, 1996

[54] RECYCLABLE PAPERBOARD COMPOSITES

[75] Inventors: Joe L. Kinsey, Jr., Irvington; Robert L. Lanham, Jr., Mobile, both of Ala.

[73] Assignee: International Paper Company, Purchase, N.Y.

[21] Appl. No.: 408,479

[22] Filed: Mar. 22, 1995

[51] Int. Cl.[6] ..... B05D 1/38

[52] U.S. Cl. ..... 427/411

[58] Field of Search ..... 427/411

[56] References Cited

U.S. PATENT DOCUMENTS

| | | | |
|---|---|---|---|
| Re. 33,376 | 10/1990 | Gibbons et al. | 428/34.2 |
| 2,369,450 | 2/1945 | Fisher et al. | 92/40 |
| 3,181,765 | 5/1965 | Bonzagni et al. | 229/3.5 |
| 3,431,166 | 3/1969 | Mizutani et al. | 162/135 |
| 3,497,487 | 2/1970 | Bristol | 260/91.3 |
| 3,541,069 | 11/1970 | Bristol et al. | 260/91.3 |
| 3,597,264 | 8/1971 | Sirota | 117/122 S |
| 3,654,064 | 4/1972 | Laumann | 161/156 |
| 3,654,247 | 4/1972 | Bristol | 260/86.1 E |
| 3,661,695 | 5/1972 | Berliner | 161/151 |
| 3,790,067 | 2/1974 | Scheier | 229/55 |
| 4,131,581 | 12/1978 | Coker | 260/29.1 R |
| 4,136,798 | 1/1979 | Oberstein | 220/408 |
| 4,586,643 | 5/1986 | Halabisky et al. | 229/3.1 |
| 5,059,459 | 10/1991 | Huffman | 428/34.2 |

FOREIGN PATENT DOCUMENTS

| | | | |
|---|---|---|---|
| 0014935 | 11/1965 | Netherlands | 427/411 |

OTHER PUBLICATIONS

Abstract JP 62–159044 dated Jul. 15, 1987 (abstract only).

*Primary Examiner*—Peter A. Szekely
*Attorney, Agent, or Firm*—Luedeka, Neely & Graham P.C.

[57] ABSTRACT

The specification discloses a multilaminar paperboard composite having improved recyclability and methods for forming and recycling the paperboard composite. The paperboard composite comprises a paperboard substrate having two surfaces, a highly alcoholized polyvinyl alcohol binder layer adjacent at least one surface of the paperboard substrate and a polyethylene polymeric layer bound to the polyvinyl alcohol layer. The highly alcoholized polyvinyl alcohol layer is present in an amount of from about 2 to about 12 pounds per 3000 square feet of substrate.

8 Claims, No Drawings

RECYCLABLE PAPERBOARD COMPOSITES

FIELD OF THE INVENTION

The invention relates to methods and compositions useful for improved recovery of coated paperboard composites.

BACKGROUND

In today's environmentally conscious society, the environmental impact of disposal containers is of great concern. One area of concern that remains to be adequately addressed is the recyclability of paperboard packages coated with polymeric materials such as polyethylene. While such coated paperboard packages are generally recyclable, a small but significant portion of the composite paperboard packages now commercially available cannot be efficiently or economically recycled with current technology. The inability to recycle 100 percent of the polymeric material and paperboard substrate of the coated paperboard packages is due, at least in part, to the low-value of fiber-contaminated polymer that must be disposed of by means other than recycling.

Various techniques for the partial recycling of coated paperboard composites are commercially available. One common technique is the repulping of the coated paperboard whereby polymeric coating material is separated from the paperboard substrate by floatation. Another technique is the use of organic solvents to dissolve the polymeric coating and thereby separate the polymeric coating from the substrate. While these techniques are relatively simple, at best only about 98 wt. % of the paperboard fiber is recoverable and typically only 50 wt. % to 75 wt. % of the paperboard fiber is recoverable. Furthermore, the polymeric material which may contain as little as 2 wt. % fiber has little or no value due to its fiber content. If solvents are used to dissolve the polymeric material, expensive distillation, extraction or other separation techniques are required to recover the polymeric material from the solvent. Consequently, the polymeric material separated from the paperboard substrate is generally landfilled or incinerated.

If, on the other hand, essentially all of the paperboard substrate and polymeric coating material is recoverable, there would be an economic incentive to recycle more of the polymeric material coated paperboard containers. Currently, the economics of recycling such coated paperboard containers are adversely impacted by the cost for landfill and/or incineration of the low-value, fiber or solvent contaminated polymeric material.

It is therefore an object of the invention to provide compositions and methods which enhance the recoverability of polymeric material coated paperboard composites.

Another object of the invention is to provide a method for recycling and recovering polymeric coatings and paperboard substrates from polymer coated paperboard composites using commercially available repulping techniques.

Yet another object of the invention is to provide a method for increasing the rate of recovery of polymeric coating material and paperboard substrate in a commercially acceptable manner.

Other objects and benefits of the invention will be evident from the ensuing description and appended claims.

SUMMARY OF THE INVENTION

With regard to the foregoing and other objects, the present invention provides a polymer coated multilaminar paperboard composite comprising a paperboard substrate having two surfaces, a highly alcoholized polyvinyl alcohol binder layer adjacent to at least one surface of the paperboard substrate and a polyethylene layer bound to the polyvinyl alcohol layer, wherein the highly alcoholized polyvinyl alcohol layer is present in an amount of from about 2 to about 12 pounds per 3000 square feet (about 0.9 to about 5.4 kg/280 $m^2$) of substrate.

The products of the invention greatly enhance the recyclability of coated paper and paperboard composites. Accordingly, up to about 95 wt. % or more of the polymeric coating and substrate may be recovered and recycled using the products and methods of the invention without the need for solvents and/or complicated coating removal techniques.

In another embodiment, the invention provides a method for making recyclable coated paperboard composites. The recyclable composites are made from a cellulosic paperboard substrate having two surfaces by coating at least one surface of the substrate with a highly alcoholized polyvinyl alcohol binder. A polyethylene coating layer is then applied to the polyvinyl alcohol binder to provide a paperboard composite. The amount of polyvinyl alcohol coating applied to the substrate is in a range of from about 2 to about 12 pounds per 3000 square feet (about 0.9 to about 5.4 kg/280 $m^2$) of substrate.

The adherence of a coating to a paper or paperboard substrate is due, at least in part, to the penetration of substrate fibers into the coating layer. From an adherence point of view it is desirable to have as many fibers penetrate and anchor themselves in the coating layer as possible. However, complete separation of the substrate from the coating becomes increasingly more difficult as the number of fibers anchored in the coating layer increases. By using a highly alcoholized polyvinyl alcohol as a binder layer between the polymeric coating and substrate, fewer substrate fibers are allowed to penetrate and anchor themselves in the polymeric coating. The substrate fibers are anchored in the polyvinyl alcohol layer which serves as a bridge to adherently bind the polymer coating to the substrate. Since the bulk of the substrate fibers do not extend past the binder layer into the coating layer, there is more complete separation between the substrate and the polymeric coating layer.

A further embodiment of the invention provides a method for recovering paperboard fibers and a polymeric coating material from a coated paperboard substrate. The method comprises first chopping or otherwise mechanically subdividing or disintegrating a fibrous paperboard substrate coated with a polyethylene layer and a highly alcoholized polyvinyl alcohol binder interposed between the substrate and polyethylene layer. Next the chopped substrate is fed to a repulper such as a Hydrapulper containing hot water and, preferably, alkali, for dissolution of the polyvinyl alcohol binder and disintegration of the substrate into individual fibers and small fiber bundles. Finally the polyethylene coating, now also disintegrated into small particles in an aqueous slurry containing paperboard fibers, polyethylene particles and dissolved polyvinyl alcohol are separated one from the other as by floatation separation, screening or centrifuging thereby recovering substantially polyethylene free paperboard fibers and substantially fiber and polyvinyl alcohol free polyethylene.

A still further embodiment of the invention provides a method for recovering paperboard fibers and a polymeric coating material. The method comprises first chopping or otherwise mechanically subdividing or disintegrating a multilaminar fibrous paperboard substrate coated with polyethylene and a highly alcoholized polyvinyl alcohol binder layer interposed between the substrate and the polyethylene layer. The highly alcoholized polyvinyl alcohol is present in the coating an amount ranging from about 2 to about 12 pounds per 3000 square feet of substrate and the polyvinyl alcohol has a degree of hydrolysis of greater than about 99%. Next the chopped substrate is fed to a vessel containing water. A partial vacuum is momentarily applied to the headspace of the vessel containing the chopped substrate. The partial vacuum is applied and released for a number of cycles (typically 3) sufficient to effectively wet the fibrous substrate. The water containing the chopped and wet substrate is then heated to a temperature sufficient to dissolve the highly alcoholized polyvinyl alcohol layer. Next the chopped substrate is soaked for a period of time at the dissolving temperature which time and temperature are sufficient to dissolve the highly alcoholized polyvinyl alcohol layer thereby effectively separating substrate fibers and polyethylene particles one from the other and disintegrating the substrate into individual fibers and small fiber bundles. Once the paperboard fibers, polyethylene particles and dissolved polyvinyl alcohol are separated one from the other, an aqueous slurry containing the paperboard fibers, the polyethylene particles and dissolved polyvinyl alcohol may be recovered as by floatation separation, screening or centrifuging in order to obtain substantially polyethylene free paperboard fibers and substantially fiber and polyvinyl alcohol free polyethylene.

DETAILED DESCRIPTION OF THE INVENTION

The invention is directed to the production, use and recycling of paperboard composites containing one or more polymeric layers or coatings, particularly a polyethylene barrier layer, and especially a low density polyethylene barrier layer applied to a paper or paperboard substrate such as multiply bleached kraft carton material for packaging various consumer products, for example, dairy products and juices and any other polyethylene-coated paper and board products. The invention involves the use of a water dissolvable or dispersible material interposed between the polymer layer and the substrate to bind the two together. A preferred binder is substantially insoluble in water below about 170° F. (77° C.), but becomes soluble or dispersible in water having a temperature above about 170° F. (77° C.). The solubility of the binder for use in the composite of the invention may be determined by how readily the substrate and coating separate from one another in hot water. Generally speaking, the more readily the coating releases from the substrate, the more suitable is the binder for use in the invention.

The invention employs as a binder for the polymeric coating a highly alcoholized polyvinyl alcohol (PVA) as distinguished from conventional alcoholized polyvinyl alcohols. Highly alcoholized means that the degree of hydrolysis of the PVA is greater than about 98%, most preferably greater than about 99%. For food container applications, the PVA is a food and drug grade material. A particularly preferred highly alcoholized PVA is the PVA having a degree of hydrolysis of 99.3% or more available from Air Products, Inc. located in Allentown, Pa., under the trade designation AIRVOL 165.

Highly alcoholized PVA binders for use in the invention may be produced from polyvinyl esters such as polyvinyl acetate since the vinyl alcohol monomer itself is unstable and will readily rearrange to acetaldehyde. Vinyl acetate, which is polymerized to polyvinyl acetate, may be made by the addition of acetic acid to acetylene in the presence of mercuric sulfate. Methods for the production of polyvinyl acetate are well known in the art.

Polyvinyl acetate may then be converted to polyvinyl alcohol by the acid catalyzed hydrolysis of polyvinyl acetate. Suitable catalysts include p-toluenesulfonic acid, benzenesulfonic acid, phenolsulfonic acid, xylenesulfonic acid, hydrochloric acid, sulfuric acid, nitric acid, and phosphoric acid.

A preferred reaction for production of PVA for the invention is the hydrolysis of polyvinyl acetate by methanol in an acid or base catalyzed reaction. In this case, polyvinyl alcohol and methyl acetate are formed. Methyl acetate, having a lower boiling point than polyvinyl alcohol, may be readily removed from the reaction product mixture by distillation. The degree of alcoholysis obtained is determined by the number of acetate groups which have been hydrolyzed. Methods for increasing the degree of alcoholysis are well known in the art. See for example, U.S. Pat. No. 3,497,487 to Bristol; U.S. Pat. No. 3,541,069 to Bristol, et al.; and U.S. Pat. No. 3,654,247 to Bristol, all of which are incorporated herein by reference as if fully set forth. Such highly alcoholized polyvinyl alcohols are typically insoluble in cold water, i.e., have a cold water solubles content of less than 10% by weight at 77° F. (25° C.) and are highly soluble in hot water, i.e., have a water solubles content of greater than 50% by weight at a temperature of 176° F. (80° C.)or higher.

Besides having a degree of hydrolysis of greater than 99%, the PVA binder preferably has a viscosity of greater than about 40 to about 75 centipoise in a 4% aqueous solution at 20° C., more preferably greater than about 55 centipoise, and most preferably from about 60 to about 75 centipoise. Typically the binder will also have a number average molecular weight of from about 5,000 to about 110,000, with higher molecular weights being preferred.

The substrate coated with the highly alcoholized binder and polymeric coating of this invention is a cellulosic fibrous material which is to be recycled. The substrate may therefore be composed of a single cellulosic layer of fibrous material or the substrate may contain a plurality of cellulosic layers. Such multilayer cellulosic substrates are used in producing liquid containers, cartons and the like for milk, juices and other liquids. Until now, however, these cartons and containers have not been fully recyclable due to the inability to completely separate the cellulosic fibers and coating material from one another.

Once formed, the single or multilaminar cellulosic substrate may be coated on one or both surfaces depending on the particular application for which the coated substrate is used. Regardless of whether one or both surfaces of the substrate are coated, this invention provides compositions and methods for enhancing the recyclability of such coated substrate composite materials.

To produce the coated substrate of the invention, the fibrous substrate is first coated with a binder, preferably the highly alcoholized PVA herein described so that the total binder coating ranges from about 2 to about 12 pounds per 3000 square feet (about 0.9 to about 5.4 kg/280 $m^2$) of substrate.

The substrate may be coated with the binder by first dissolving about 10 parts of the binder in about 90 parts of water at a temperature above about 80° C. The resultant solution may then be applied to the cellulosic substrate by conventional methods such as spraying, roll coating, doctor blade, brushing or any other suitable coating technique. If desired, the binder may also be extruded onto the substrate from a melt of the binder without first dissolving the binder in water.

Once coated with the binder, the binder coated substrate may then treated by flame or corona discharge techniques to enhance the binding characteristics of the binder with the polymeric layer. These treating techniques are well known in the art. In the alternative, a tie layer may be applied to the binder or an amphiphilic additive such as that disclosed in U.S. Pat. No. 5,190,816 to Gardiner et al., which is incorporated herein by reference as if fully set forth, may be added to the polymeric material to enhance the adherence between the binder and the polymeric layer. A preferred polymeric layer generally includes one or more tie layers of ethylene-based copolymers modified with functional groups such as PLEXAR 175 or PLEXAR 177, available from Quantum Chemical Corporation located in Cincinnati, Ohio, used in combination with a low density polyethylene (LDPE) layer, an ethylene vinyl alcohol copolymer (EVOH) layer, a combination of layers of LDPE and EVOH, or any other desired polymeric material layers suitable for making coated paperboard composites. Particularly preferred ethylene vinyl alcohol copolymers are available from the Eval Company of America located in Lisle, Ill., and are sold under the trade name EVAL EP. Low density polyethylene may also be used alone as the tie layer. If the paperboard composites are used for food packaging, the polymeric layers should also be FDA approved for direct food contact.

Like the binder layer, the polymeric layer may also be applied to the substrate containing the binder layer by spraying, roll coating, doctor blade, brushing or any other suitable coating technique. Typically, the polymeric layer is extrusion coated from a melt directly to the binder layer. This invention is not limited to the use of one such polymeric layer, as a plurality of polymeric layers may also be used. The total amount of polymeric layer used in making the paperboard substrate will usually be in the range of from about 10 pounds per 3000 square feet (4.5 kg/280 $m^2$) to about 40 pounds per 3000 square feet (18 kg/280 $m^2$).

If both sides of the substrate are to be coated, then prior to applying the polymeric layer, both sides of the substrate should be coated with the hot water soluble or dispersible binder layer in order to enhance the recyclability of the paperboard composite.

To separate the polymeric layer and the fibrous substrate as in a recycling operation, the composite is preferably first chopped, shredded or otherwise subdivided into small pieces and the resulting material is soaked in a vessel containing hot water for a period of time sufficient to dissolve or disperse the binder layer, resulting in release of the polymeric layer from the fibrous substrate. Hot water may be added to the chopped composite which was previously charged to a vessel, or more preferably, the composite is added to a vessel containing hot water.

Thus, to enhance the action of the hot water on the composite, it is preferably chopped, shredded, or torn so as increase the surface area for contact with the hot water to expose as much of the binder to water as is reasonably practical. If there are no or only a few discontinuities in the barrier layer as are created by chopping or tearing the substrate, it may be difficult or take more time for the water to act upon the binder. While there may be a practical limit to the size of the chopped or shredded composite pieces, generally the smaller the pieces, the more efficient will be the coating release process. In the alternative, the chopped composite containing the binder and polymeric coated may be fed directly to a HYDRAPULPER repulper for treatment using well known repulper techniques in which the composite is disintegrated by the rotor and mechanical agitation in the process.

It is important that the water used for removing the barrier films from paperboard substrates be hot enough to dissolve the binder layer in a reasonable amount of time. Accordingly, the water temperature for soaking the composite material should be above about 176° F. (80° C.), more preferably above about 185° F. (85° C.) and most preferably in the range of from about 194° F. (90° C.) to about 302° F. (150° C.). The water may be heated prior to introducing the substrate to the vessel, or it may be heated once the substrate is in the vessel. Either sequence may be used provided the water is heated and maintained at the desired temperature for a period of time sufficient to dissolve the hot water dissolvable layer.

Agitation of the hot water containing the shredded paperboard composite material may be performed to increase the dissolution rate. However, the agitation rate is not believed to be critical to the invention.

Once the polymeric coating has released from the substrate due to dissolution of the binder layer, the polymeric and fibrous material may be recovered by conventional methods known to those of ordinary skill such as floatation, skimming, screening or centrifuging the slurry. Although the invention has been described as removing the polymeric materials from the substrate, such terminology is not intended to convey a particular mechanism or sequence of events. Accordingly, the fibrous substrate and polymeric materials are separated one from the other by the methods of this invention.

In another alternative procedure, the chopped composite is fed to a pressure vessel containing water at room temperature. A subatmospheric pressure is applied to the headspace of the vessel for a period of time sufficient to enhance wetting of the chopped material. A suitable subatmospheric pressure is in the range of from about 254 to about 650 mm Hg. Once the pressure in the vessel reaches the desired subatmospheric pressure, the vacuum is released. Subatmospheric pressure is applied to the vessel and released at least once, preferably twice, and more preferably at least three times so that the composite material is sufficiently wet. It is particularly preferred to use vacuum conditions to promote wetting of high wet strength paper and board products.

Subsequent to the subatmospheric pressure wetting procedure, the water containing the chopped substrate is then heated to a temperature for a period of time sufficient to dissolve or disperse the binder layer. As noted above, the water temperature is preferably above about 176° F. (80° C.), more preferably above about 185° F. (85° C.) and most preferably in the range of from about 194° F. (90° C.) to about 302° F. (150° C.).

As before, once the polymeric material has released from the vacuum wetted and heat soaked composite material by dissolution of the binder layer, the insoluble polymeric and fibrous material may be recovered by conventional methods. If recovery of the binder from the water is desired, such recovery may be obtained by cooling the water after fiber separation until the binder precipitates or by distillation or extraction techniques. The water containing the dissolved binder may also be used without first separating the binder from the fibrous substrate.

In order to further illustrate the invention, the following non limiting examples are given.

EXAMPLE 1

A 10% by weight solution of AIRVOL 165 super-hydrolyzed polyvinyl alcohol (PVA) from Air Products, Inc. was prepared by dispersing 10 parts of PVA in 90 parts distilled water and heating and agitating the mixture at 182° F. (82° C.) until the PVA was completely dissolved (about 30 minutes). Sheets of milk carton board were coated on one surface with low density polyethylene and the PVA solution was drawn down on the uncoated surface using a #8 Meyer rod. The coated sheets were dried in a laboratory oven at about 151° F. (66° C.) for 10 minutes. Two sets of coated sheets were made, one with a single drawdown of PVA and the other having a second drawdown of PVA over the first drawdown. The sheets were then taped to a web and PLEXAR 175 (a modified low density polyethylene tie resin from Quantum Chemical Corporation of Cincinnati, Ohio) at about 12 lbs/ream (5.44 kg/ream) was extruded on the PVA coated side of the sheets.

The sheets of single drawdown and double drawdown samples with PLEXAR 175 overcoat were cut into 2.54 centimeter squares. Ten squares of each single and double drawdown sheets were placed in beakers of 199° F. (93° C.) water. The time of the first film release from a square was observed and recorded as well as the time required for all ten squares of each drawdown sample to release the PLEXAR films. Table 1 is a tabulation of the observed results.

TABLE 1

| | 1 Drawdown of PVA | 2 Drawdowns of PVA |
|---|---|---|
| Release of 1st film (min.) | 16 | 6 |
| Release of all films (min.) | 24 | 22 |

Approximately 100% of the original PLEXAR coating was recovered from the water. Upon microscopic examination, the recovered coating was determined to be essentially fiber-free.

EXAMPLE 2

A 10% by weight solution of AIRVOL 165 super-hydrolyzed polyvinyl alcohol (PVA) from Air Products, Inc. was prepared by dispersing 10 parts of PVA in 90 parts distilled water and heating and agitating the mixture at 180° F. (82° C.) until the PVA was completely dissolved (about 30 minutes). Sheets of milk carton board were coated on one surface with polyethylene and the PVA solution was applied to the uncoated surface using a #8 Meyer rod. The coated sheets were dried in a laboratory oven at about 151° F. (66° C.) for 10 minutes. Two sets of coated sheets were made, one with a single drawdown of PVA and the other having a second drawdown of PVA over the first drawdown. The sheets were then taped to a web and PLEXAR 175 (a modified polyethylene tie resin of EVOH from Quantum Chemical Corporation) at about 12 lbs/ream (5.44 kg/ream) was extruded on the PVA coated side of the sheets.

The sheets of single drawdown and double drawdown samples with PLEXAR 175 overcoat were cut into 2.54 centimeter squares. Ten squares of each single and double drawdown sheets were placed in beakers of 77° F. (25° C.) water. Subatmospheric pressure was applied to the beakers until the pressure reached 56 mm Hg. The vacuum was released and repeated several times while the squares were submerged in the water. When the squares appeared to be completely wet, the beakers containing the water and squares were heated to 199° F. (93° C.). The time of the first film release from a square was observed and recorded as well as the time required for all ten squares of each drawdown sample to release the PLEXAR films. Table 2 is a tabulation of the observed results.

TABLE 2

| | 1 Drawdown of PVA | 2 Drawdowns of PVA |
|---|---|---|
| Release of 1st film (min.) | 4 | 1 |
| Release of all films (min.) | 10 | 9 |

Approximately 100% of the original PLEXAR coating was recovered from the water. Upon microscopic examination, the recovered coating was determined to be essentially fiber-free.

Having described the invention in its preferred embodiments, it will be recognized that variations of the invention by those skilled in the art are within the spirit and scope of the appended claims.

What is claimed is:

1. A method for making recyclable coated paperboard composites comprising providing a cellulosic paperboard substrate having two surfaces, applying adjacent at least one surface of the substrate a highly alcoholized polyvinyl alcohol binder layer and applying a polyethylene coating layer to the polyvinyl alcohol binder layer, wherein the polyvinyl alcohol coating layer is applied in an amount of ranging from about 2 to about 12 pounds per 3000 square feet of substrate.

2. The method of claim 1 wherein the polyvinyl alcohol has a degree of hydrolysis of greater than about 99%.

3. The method of claim 2 further comprising a tie layer interposed between the polyvinyl alcohol layer and the polyethylene layer.

4. The method of claim 3 wherein the tie layer is an ethylene vinyl alcohol copolymer.

5. The method of claim 3 wherein the tie layer is a modified low density polyethylene.

6. The method of claim 1 further comprising a tie layer interposed between the polyvinyl alcohol layer and the polyethylene layer.

7. The method of claim 6 wherein the tie layer is an ethylene vinyl alcohol copolymer.

8. The method of claim 6 wherein the tie layer is a modified low density polyethylene.

* * * * *